US006457412B1

(12) United States Patent
Jones

(10) Patent No.: US 6,457,412 B1
(45) Date of Patent: Oct. 1, 2002

(54) CYLINDER IMPURITY REMOVER APPARATUS

(75) Inventor: Phillip E. Jones, Mulvane, KS (US)

(73) Assignee: Printing Research, Inc., Dallas, TX (US)

( * ) Notice: Subject to any disclaimer, the term of this patent is extended or adjusted under 35 U.S.C. 154(b) by 0 days.

(21) Appl. No.: 09/729,026

(22) Filed: Dec. 4, 2000

(51) Int. Cl.[7] ..... B41F 35/00
(52) U.S. Cl. ..... 101/423; 101/425
(58) Field of Search ..... 101/423, 425, 101/424, 416.1, 169, 167

(56) References Cited

U.S. PATENT DOCUMENTS

| | | | | |
|---|---|---|---|---|
| 5,167,189 | A | 12/1992 | Jones | |
| 5,345,865 | A | 9/1994 | Kemp | |
| 5,400,711 | A | 3/1995 | Kemp | |
| 5,584,243 | A | * 12/1996 | Kern | 101/365 |
| 5,722,321 | A | * 3/1998 | Szyszko et al. | 101/129 |
| 5,761,997 | A | * 6/1998 | Xydias | 101/169 |
| 5,809,891 | A | 9/1998 | Kemp | |
| 5,983,798 | A | * 11/1999 | Iijima et al. | 101/169 |

* cited by examiner

*Primary Examiner*—Andrew H. Hirshfeld
*Assistant Examiner*—Anthony H. Nguyen

(74) *Attorney, Agent, or Firm*—Conley, Rose & Tayon

(57) ABSTRACT

A removable, compact and easily accessible cylinder impurity remover apparatus has a wiping position for removing impurities from a rotatable printing plate cylinder on a printing press and a non-wiping position. The impurity remover removeably slides or swings into position for wiping a plate on the plate cylinder. Most preferably, a pressure source acts on two pistons to move two parallel reciprocably mounted shafts and a wiper blade mounted thereon to the wiping position. Both the pistons and shafts are preferably contained inside an actuator bar, which is mounted parallel to a printing plate cylinder. As the wiper blade moves forward to the wiping position, a bias member is compressed and remains compressed until the pressure source stops, allowing the bias member to automatically retract the reciprocably mounted shafts and wiper blade to a non-wiping position. According to one embodiment of the invention, the actuator bar is mounted on the top side of a primary support bar having a shaped track to permit a sliding movement into and out of the printing press. According to a second embodiment of the invention, the actuator bar is pivotally connected to a first main side support and the opposing end of the actuator bar is receivable in a docking portion of a second main side support for pivoting movement relative to the printing press. Both embodiments are compact and allow for the operator to easily access the wiper blade for maintenance and cleaning.

4 Claims, 6 Drawing Sheets

CYLINDER IMPURITY REMOVER APPARATUS

TECHNICAL FIELD OF THE INVENTION

This invention relates to the printing industry, and in particular, to a new and improved cylinder impurity remover apparatus to clean and remove dust and impurities therefrom.

BACKGROUND OF THE INVENTION

Impurity removers on offset printing presses are known. An example of one is found in U.S. Pat. No. 5,167,189, issued on Dec. 1, 1992 to Phillip W. Jones and is hereby incorporated by reference. During the printing process, ink and water are applied to a plate on a plate cylinder for transferring ink to a blanket on a blanket cylinder and then to paper. Frequently small impurities, clumps of ink, dust or dirt form on the plate cylinder. These irregularities cause unwanted small printing defects commonly known as "hickeys" to appear on the paper being printed. Several inventions exist directed towards preventing these "hickeys" from forming on the printed paper.

Numerous problems have existed in preventing these printing irregularities. For example, a printing press is frequently stopped to clean any impurities that form on the printing plate cylinder member. After stopping the printing press, the operator must wipe or apply some force in order to dislodge or remove the dust particle or impurity. Frequently, operators use their own thumb nail to clear the problem. This has several disadvantages. Each time the printing press is stopped for cleaning, the owner and/or operator has lost valuable operation and production time. Further, re-starting is time consuming and an expensive procedure as the initial output of the printing press will produce poor quality print and will continue until the ink and dampening system is at the proper operating balance, sometimes taking several minutes. When impurities form on the plate cylinder, the operator of the printing press must manually clean the components risking bodily injury. This requires the operator to insert his hands and arms into small openings in order to properly clean the cylinder, often risking serious injury. More importantly, the printing machine could be mistakenly turned on which might result in loss of a human limb.

U.S. Pat. No. 5,167,189 is directed at preventing the above problems; however, this apparatus is somewhat difficult to remove for cleaning and maintenance. Further, the operator was required to align the actuator housings and wiper blade to be perfectly parallel to the plate cylinder so as to have a uniform application of the wiper blade to the printing cylinder. This required the operator to periodically check the alignment and readjust the alignment, if necessary. Reaching into confined space to make these adjustments was difficult and potentially dangerous.

The present invention is aimed at improving the '189 Patent by incorporating fewer parts, by modifying the apparatus to be smaller to allow for usage in various printing presses where space is limited, by re-configuring the apparatus to allow for easy access when maintenance or cleaning is required, and to have a more reliable impurity remover.

SUMMARY OF THE INVENTION

In accordance with one aspect of the present invention, a cylinder impurity remover is provided which includes a wiper blade and an actuator bar assembly that is anchored to a printing press frame to temporarily engage the wiper blade with a printing cylinder. During the period of engagement, the printing cylinder is rotating and the wiper blade cleans the rotating surface to remove any impurities that may exist on the printing plate on the cylinder surface.

During operation of the cylinder impurity remover, a pressure supply is provided to the actuator bar, where preferably two parallel piston cylinders (operators) are spaced apart from each other. The piston cylinders are located in blind cylinder chambers or bores that are bored into the actuator bar itself. The actuator bar also houses two parallel reciprocably mounted shafts that hold the wiper blade parallel to the printing cylinder. These are also mounted in bores that extend through the actuator bar next to piston cylinder bores. When a cylinder chamber is pressurized, the piston exerts a forward force on a push block, which is connected to a shaft, causing the shaft to move forward in the direction of the printing cylinder. The shaft is connected to a blade holder and wiper blade which engages with the surface of the printing cylinder. As the forward movement of the shaft occurs, a spring contained in the actuator assembly is compressed. The compressed spring and wiping blade remain in the same position until the fluid pressure supply is discontinued. When the force applied by the fluid pressure supply is stopped, the force from the compressed spring retracts the shaft and wiper blade from the wiping position. This process is periodically repeated in order to maintain a clean and smooth printing surface during the operation of the printing press.

The present invention permits quick and easy removal of the wiper blade assembly for maintenance, cleaning and replacement. The cylinder impurity remover apparatus is installed and removed from the side of the printing press by sliding the actuator bar along a shaped track support which is referred to as a primary support bar. The actuator bar contains a mating slot to engage and align with the support bar. As compared to the prior art, fewer and simpler parts are required. The present invention has fewer parts and simpler parts because the most of the operating components are located in and part of the actuator bar itself and thereby removed as a unit when the actuator bar is slid in and out of the press from the side of the press.

In accordance with another embodiment of the invention, the actuator bar assembly is modified for printing units or stands where there is more space for installation of the impurity remover. This typically occurs at the first printing unit or stand. One end of the actuator bar is connected to the side frame of the press with a hinged support and the other end is docked into another side support on the other side frame of the press. This embodiment permits the actuator bar to be pivoted or swung outward for maintenance or cleaning purposes.

BRIEF DESCRIPTION OF THE DRAWINGS

A more complete understanding of the invention and its advantages will be apparent from the following detailed description when taken in conjunction with the accompanying drawings in which.

DETAILED DESCRIPTION OF THE INVENTION

Figure 1:
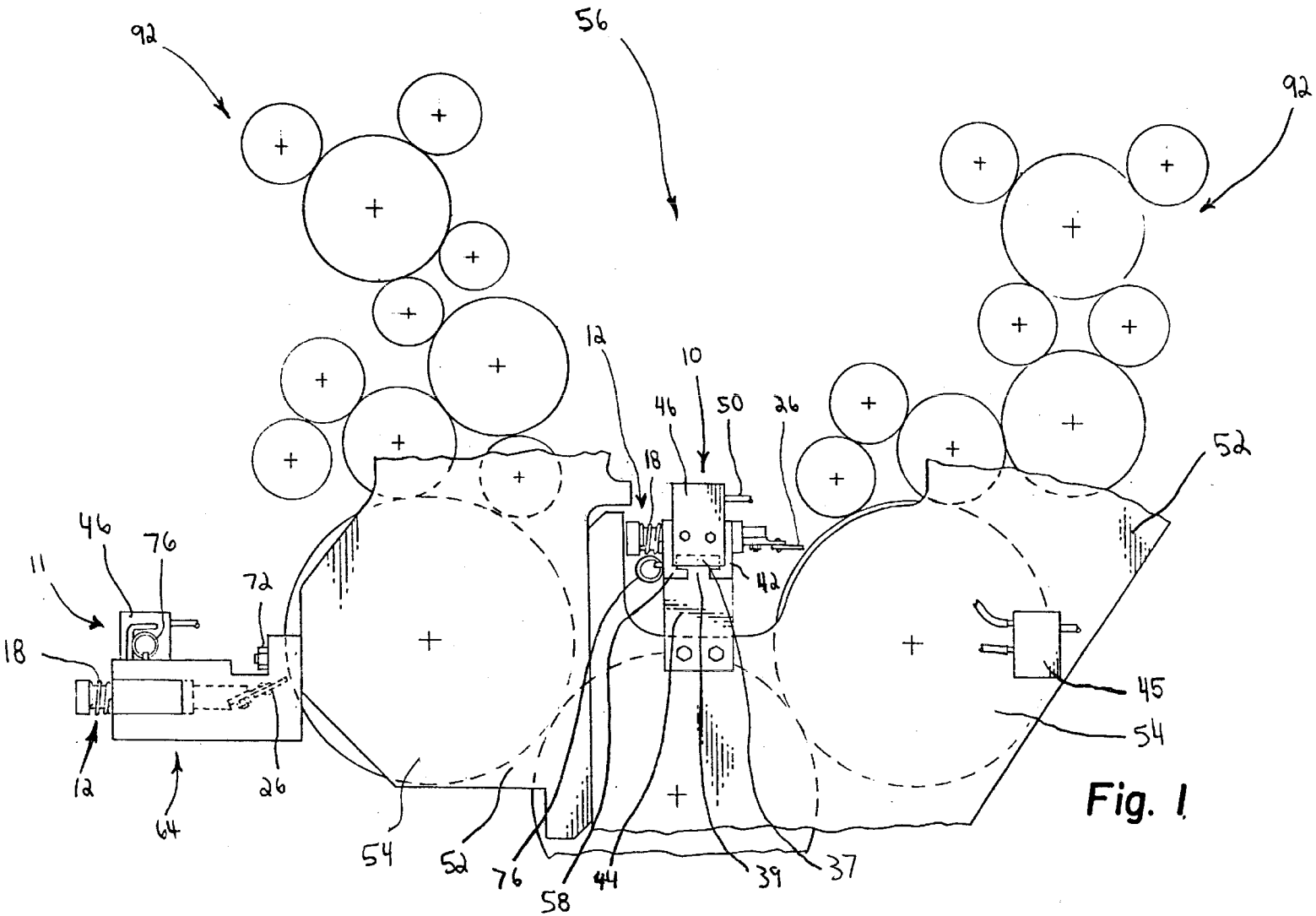
FIG. 1 is a simplified side view of the printing press assembly containing the first and second embodiments of the invention.

Referring now to the drawings wherein like reference characters designate like or corresponding parts throughout the several views, and in particular to FIG. 1, a printing press assembly 56 is illustrated. A first embodiment 10 location and a second embodiment 11 location can be seen on press assembly 56 in FIG. 1.

Figure 2:
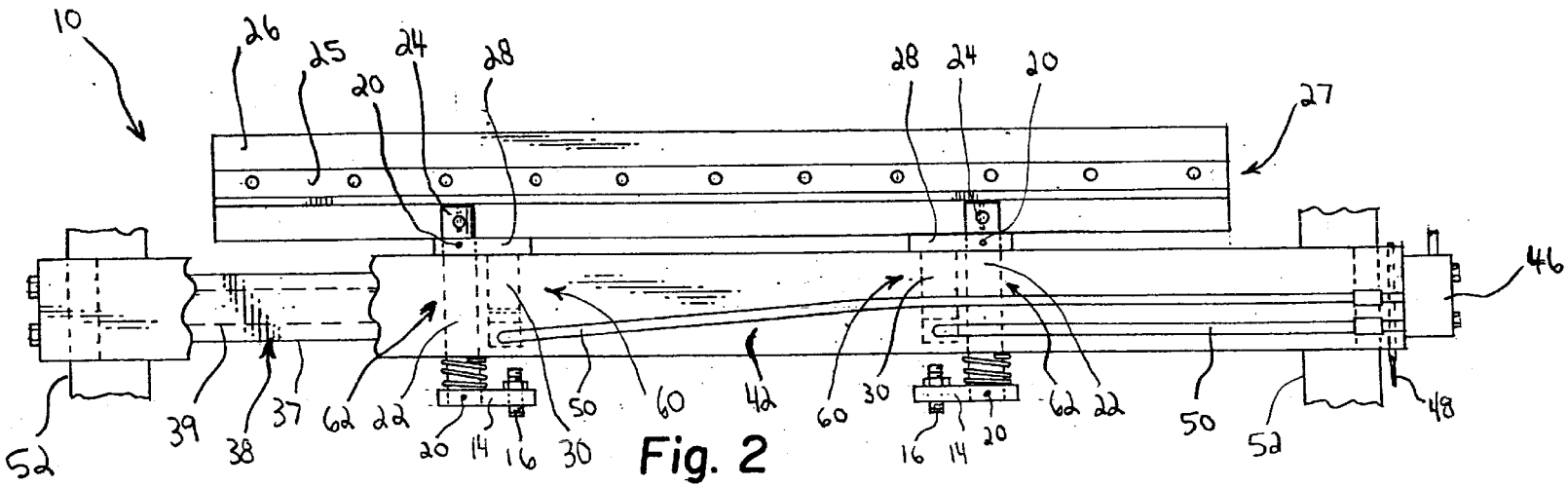
FIG. 2 is a top plan view of the actuator bar and wiper assemblies of the first embodiment.
Figure 3:
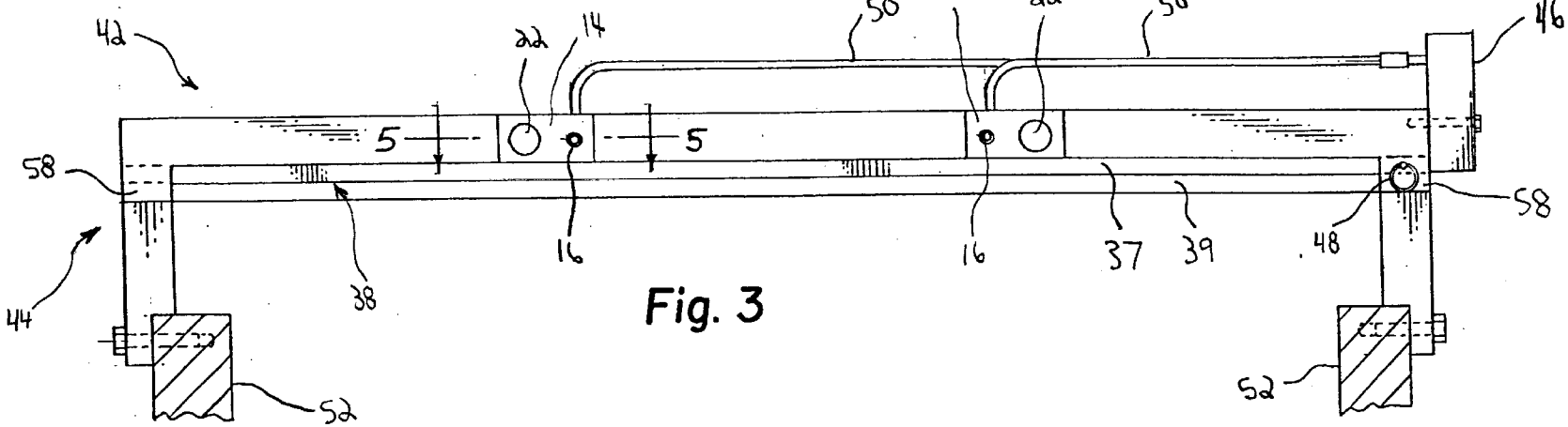
FIG. 3 is an elevation view of the actuator and support bars of FIG. 2 as seen from the back or stop bar side.
Figure 4:
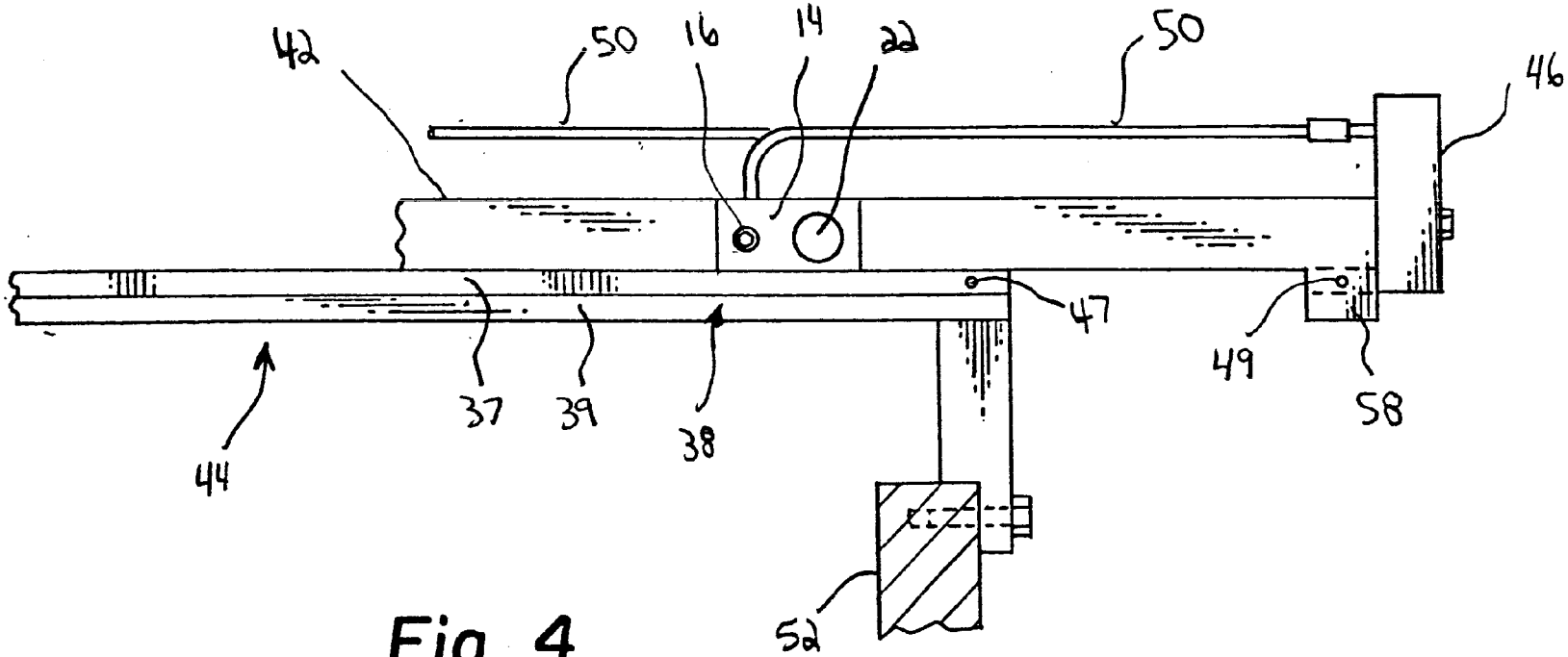
FIG. 4 is a partial elevation view of the actuator and support bars of the previous Figures as seen from the back side of the assembly wherein the actuator bar is partially removed from a press by sliding relative to the primary support bar.

The first embodiment 10 of the invention contains an actuator bar 42 as seen in FIGS. 2 and 3. Actuator bar 42 slideably attaches to the printing press via a primary support bar 38. Primary support bar 38 attaches to both sides of printing press frame 52, which supports inking and dampening roller assemblies 92 and other components of printing press assembly 56. Primary support bar 38 preferably has a "T" shaped cross sectional area which forms a track to allow actuator bar 42 to slide thereon. Actuator bar 42 contains flanges 58 located on the opposing ends of actuator bar 42 that are capable of engaging with the "T" shaped structure on primary support bar 38 in order to slide the actuator bar into the operating position, as best seen in FIG. 4. The preferred shaped structure is a "T" shaped cross section having a stem 39 and a cross bar 37. Referring to FIG. 4, primary support bar 38 contains a lock pin opening 47 and actuator bar 42 contains a actuator bar lock pin opening 49. When openings 47 and 49 are aligned, lock pin 48 may be inserted to lock bars 42 and 38 in place to keep actuator bar 42 from shifting during operation of printing press assembly 56. The flanges 58 on actuator bar 42 could be more numerous or even continuous from end to end.

Figure 6:
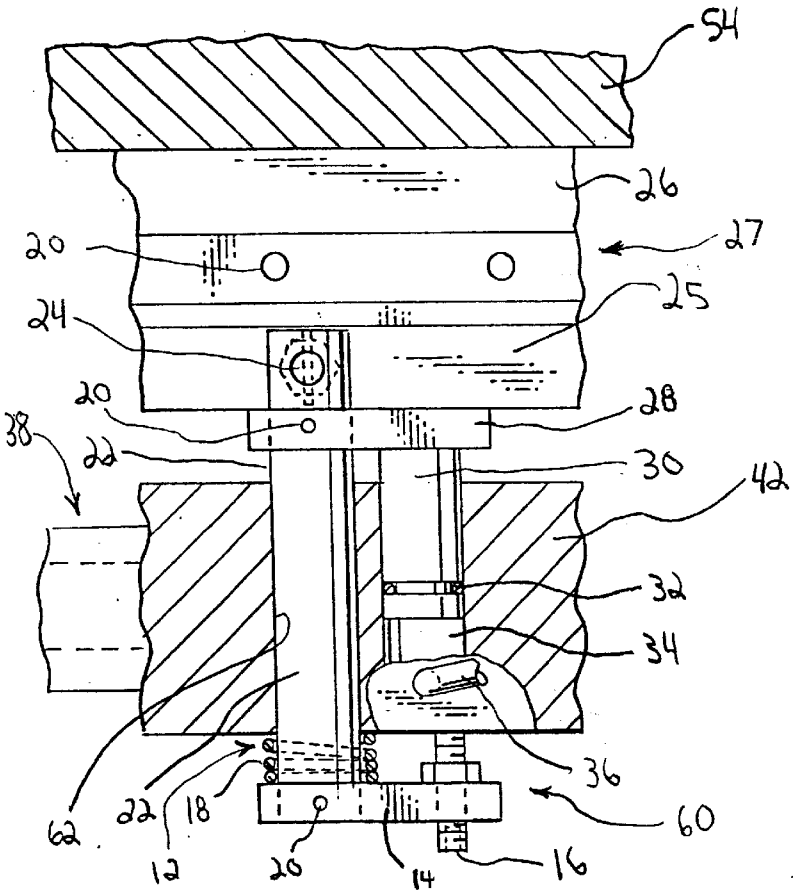
FIG. 6 is a partial section view of the actuator assembly of FIG. 5 in the wiping position, showing the air pressure inlet line into the cylinder chamber.
Figure 5:
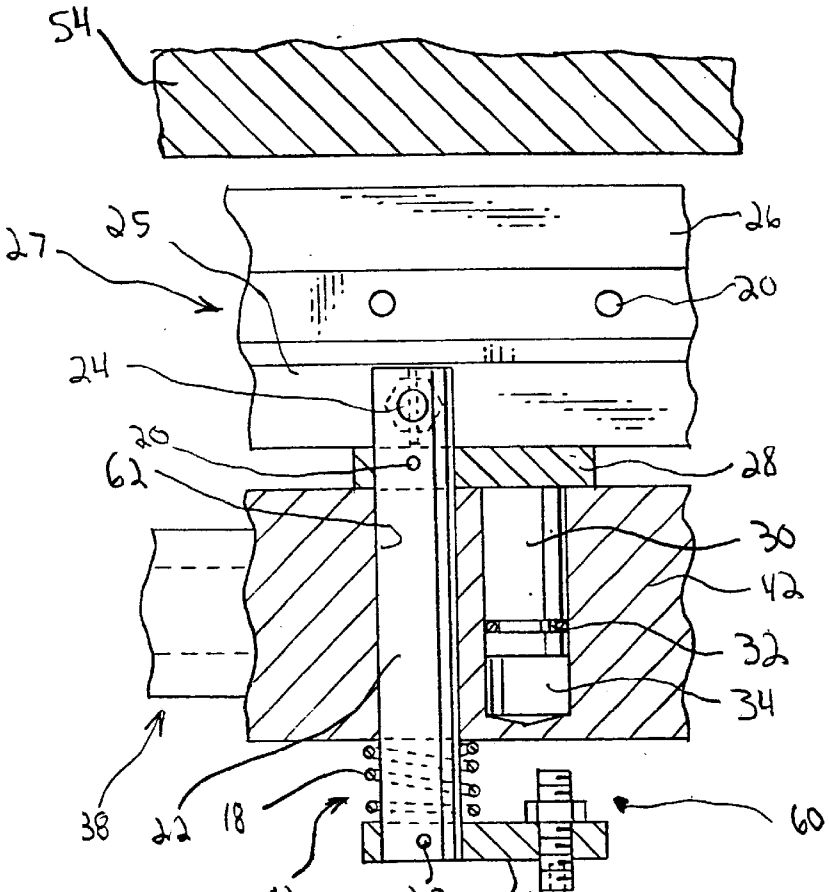
FIG. 5 is a partial section view taken on the line 5—5 in FIG. 3 of the actuator assembly in the non-wiping position.

Best seen in FIGS. 2, 5 and 6, actuator bar 42 contains two spaced and parallel bored shaft openings 62 through the entire width of bar 42 to house reciprocably mounted shaft assemblies 12. As seen in FIGS. 5 and 6, reciprocably mounted shaft assemblies 12 contain reciprocally mounted shafts 22. Stop block 14 is mounted on the back end of each shaft 22 and locked into position by lock pin 20. Bias members 18 on shafts 22 are engaged between actuator bar 42 and stop block 14. There is a push block 28 mounted on the front or opposite end of shafts 22 which is secured with lock pin 20. Reciprocably mounted shafts 22 protrude through both sides of actuator bar 42 and connect to wiper blade 26 through wiper blade holder 25 fastened to the front ends of shafts 22. Wiper blade 26 is held in blade holder 25 which is fastened by a fastener 24 to the front end of shafts 22.

Shafts 22 are moved to a wiping position of FIG. 6 or a non-wiping position of FIG. 5 by actuator assemblies 60, whereby actuator assemblies 60 are mounted at least partially in actuator bar 42. Actuators 60 include cylinder chambers 34, which provide a housing for floating pistons 30. The pistons are sealed with "O"rings 32. During the actuation cycle, floating piston 30 is acted upon by a fluid pressure force, preferably air, generated by fluid traveling through air inlet 36. Air is directed to air inlets 36 from the fluid pressure source via a hose leading to air hose junction box 46 seen in FIGS. 2 and 3. Air hose junction box 46, located on the end of actuator bar 42, contains one entrance port and two exit ports for connecting air hoses 50 to cylinder chambers 34. When floating pistons 30 are acted upon by the fluid pressure force, floating pistons 30 are driven outward (forward) to exert a force on push blocks 28. Push block 28 attached to shafts 22 then move shafts 22 to the wiping position, where the wiper blade 26 lightly contacts printing plate 54. While the present invention discusses a pneumatic fluid pressure source, the present invention can also be operated by other means such as a hydraulic fluid pressure source.

It is important that bored shaft holes 62 be parallel to each other to avoid uneven application of wiper blade 26 to a printing plate on plate cylinder 54. Tolerances between shaft 22 and bored shaft hole 62 must be controlled to avoid binding where two or more of the shafts 22 are used to support and move the wiper blade. Further, tolerances between shaft 22 and shaft hole 62, cylinder chamber 34 and floating piston 30 must be minimal to avoid dust, grease, paper particles or any other impurities which may restrict the movement of these parts. Because these "guide"openings 62 for the moveable shafts are bored into the actuator bar itself in a single setup, rather than in a subassembly or bracket, it is possible to get precise parallel alignment and precision formation of guide openings 62 for the shafts.

While the present invention exhibits two parallel shaft assemblies 12 engaging with wiper blade assembly 27, it should be realized that one shaft assembly 12 could be used in conjunction with a support structure to hold wiper blade assembly 27 in a parallel position with respect to printing plate cylinder 54. Triangularly arranged struts between a single shaft and the end portions of the wiper blade holder could maintain perpendicularity between the blade and the shaft. Guides or splines could keep the shaft from rotating from a desired position. Additionally, it should also be noted that more than two shaft assemblies could be used to move and support wiper blade assembly 27.

The wiping position is set by using adjusting screws 16, located on stop blocks 14. Adjusting screws 16 are turned to the desired setting to permit contact with actuator bar 42, which will stop movement of shaft 22 when adjusting screw 16 engages with actuator bar surface 42.

When fluid pressure acts on floating piston 30 to push shaft 22 to the wiping position, bias member 18 compresses, and remains compressed until the fluid pressure source is turned off. When the fluid pressure source terminates, the compressed spring 18 automatically retracts shaft 22 from the wiping position to a non-wiping position. This provides a fail safe operation not dependent on fluid pressure, air pressure or electrical connections. FIG. 5 shows the shaft 22 in the non-wiping position, while FIG. 6 shows shaft 22 in the wiping position.

While prior art U.S. Pat. No. 5,167,189 contained a manual push button to be operated by the user to cause the wiper to engage the printing plate, the prior art invention has been actuated automatically by a computer (not shown) that sends signals to a pressure control switch such as 45 to release fluid from a pressure source to pressurize cylinder chambers 34. The computer was pre-programmed to select the wiping frequency and the duration of wiping time per wiping cycle. The computer was programmed to place wiper blade 26 in the wiping position for three seconds, and then removed it for a 1 minute increment up to 6 minute increments, whichever is desired. The present invention improves the computer program by providing a counting feature, which counts and records how many cycles shaft assembly 12 has engaged with printing plate 54. This could be useful for the operator to determine whether wiper blade 26 must be cleaned or replaced. Additionally, the computer is improved in the present invention by a pausing function so that the operator may perform maintenance on the printing press or impurity remover assembly 10 without fear of accidental operation of the wiping function.

Figure 7:
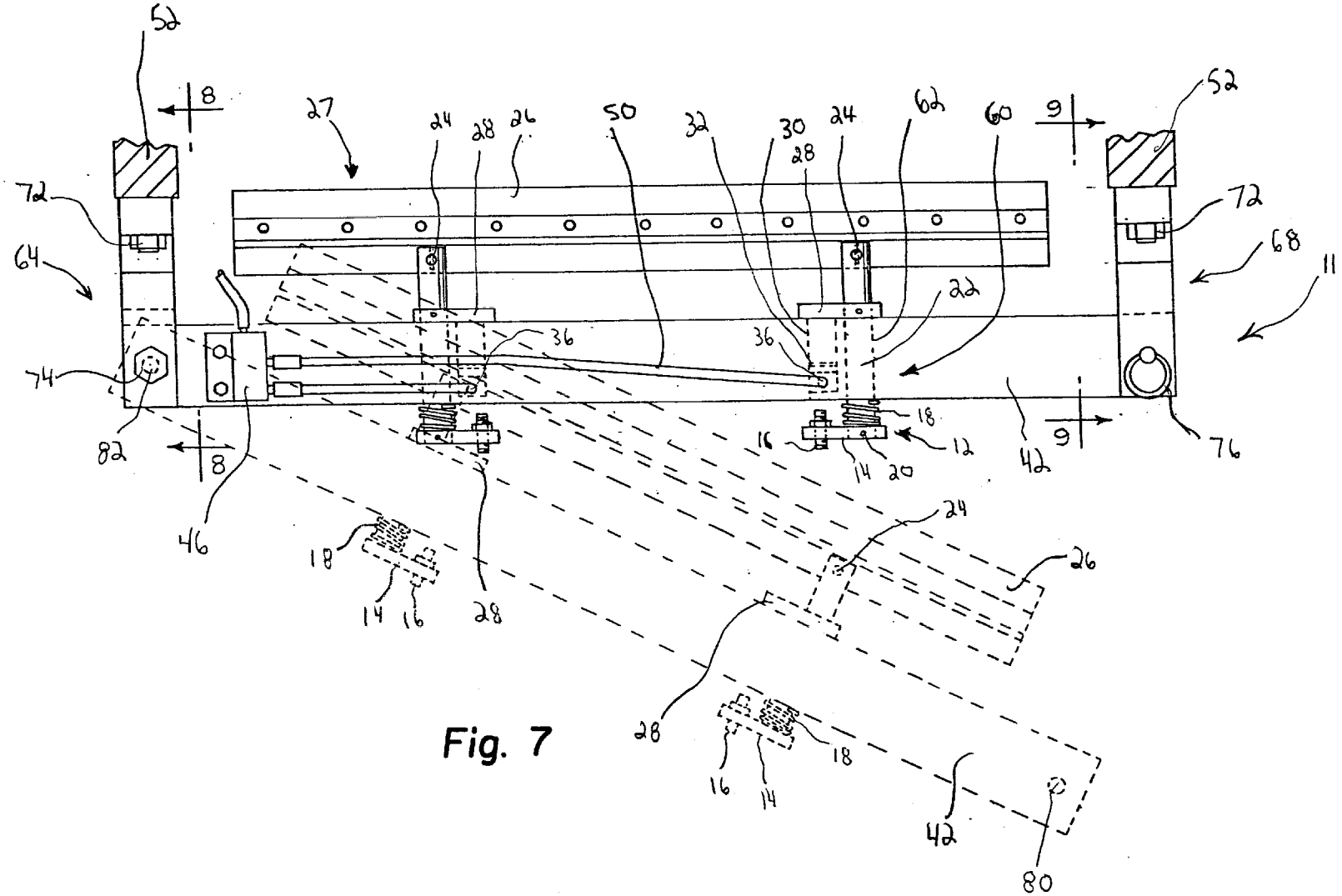
FIG. 7 shows a top plan view of the second embodiment of the invention wherein the actuator bar can be seen to pivot outward for cleaning or adjustment.
Figure 8:
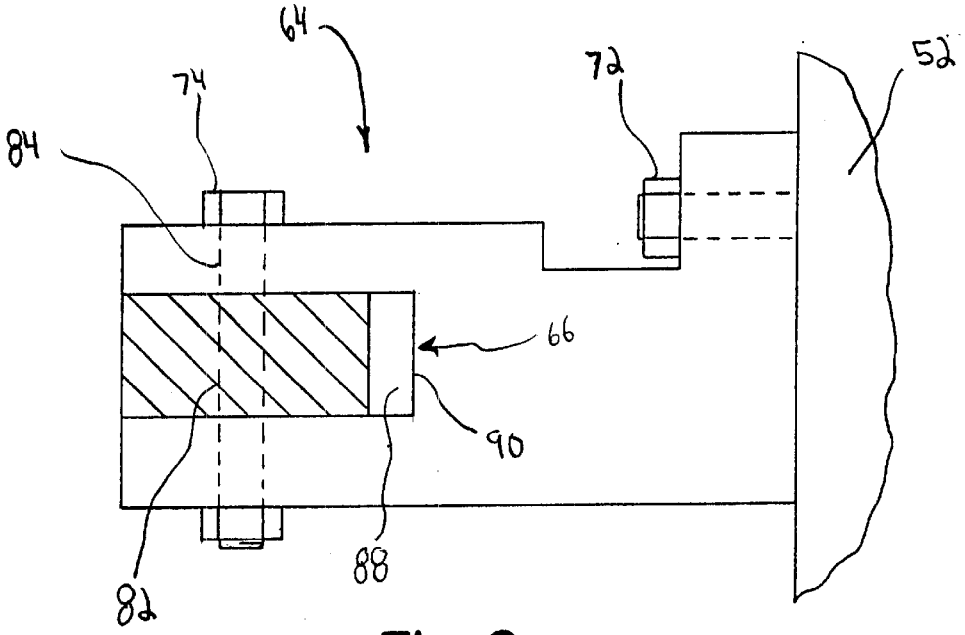
FIG. 8 shows detail view of the support structure of the second embodiment, taken on the line 8—8 in FIG. 7.

A second embodiment 11 of the invention contains an actuator bar 42 as seen in FIG. 7. The first end of actuator bar 42 is attached to printing press frame 52 by first main support 64. The opposite end of actuator bar 42 is attached to the other side of printing press frame 52 by second main support 68. Both the first main support 64 and second main support 68 are attached to printing press frame 52 by support bolts 72, as can be seen in FIGS. 8 and 9.

First support 64 contains a first docking portion 66, and second support 68 contains a second docking portion 70 to hold actuator bar 42 parallel to printing plate 54. As seen in FIG. 8, first docking portion 66 contains a pivot pin 74 which is inserted through support pivot pin opening 84 and actuator bar pivot pin opening 82 when properly aligned to permit the actuator bar to pivot and swing out at one end away from the printing cylinder it is adjacent to as seen in FIG. 7. The pivoting movement of actuator bar 42 allows for easy access to cylinder impurity remover assembly 11. Support 64 is adapted to support actuator bar 42 when it swings out.

Figure 9:
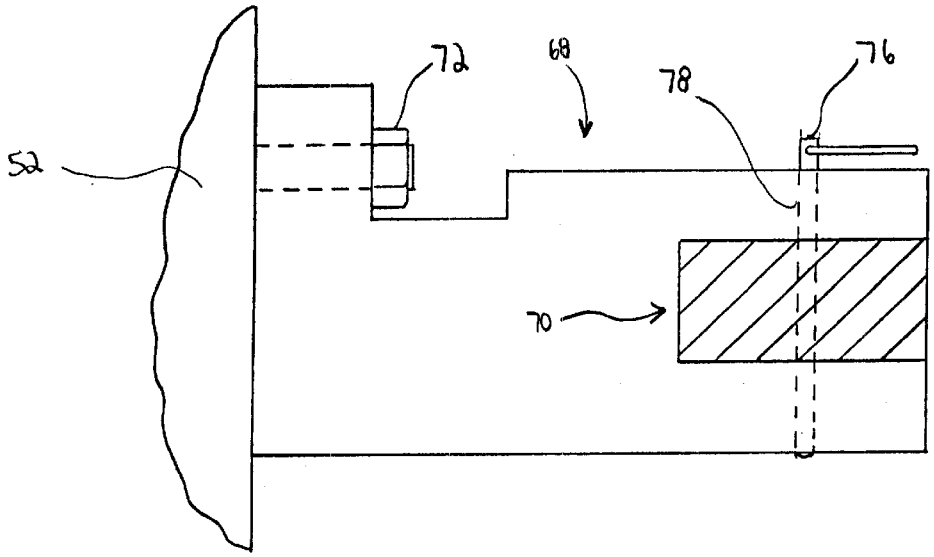
FIG. 9 shows a detail view of the support structure of the second embodiment, taken on the line 9—9 in FIG. 7.

Referring to FIGS. 7 and 9, as actuator bar 42 is pivoted forwardly towards second support 68, it is received by second docking portion 70. While in this position, bar 42 remains parallel to printing cylinder 54 and lock pin 76 should be placed through support lock pin opening 78 and actuator lock pin opening 86 to prevent further movement of actuator bar 42. Additionally, first docking portion 66 must contain a clearance space 88 to prevent actuator bar 42 from engaging with docking portion rear wall 90 when swinging or pivoting bar 42.

Additionally, referring to FIG. 1, second embodiment 11 exhibits wiper blade 26 most preferably attached to reciprocably mounted shaft 22 at a 23 degree angle from the horizontal to engage with printing plate cylinder 54.

Although multiple embodiments of the present invention have been illustrated in the accompanying drawings and described in the foregoing detailed description, it will be understood that the invention will not be limited to the embodiments disclosed, but is capable of numerous re-arrangements, modifications and substitutions of parts and elements without departing from the scope and spirit of the invention.

What is claimed is:

1. A slideably removable, compact and easily accessible cylinder impurity remover apparatus having a wiping position for removing impurities from a rotatable printing plate cylinder on a printing press and a non-wiping position, the impurity remover apparatus, comprising:

a main support assembly having a primary support bar adapted for mounting in a printing press parallel to a printing plate cylinder;

an actuator bar slideably mounted on the primary support bar for sliding movement into and out of the printing press;

an impurity remover actuator assembly mounted at least partially in the actuator bar, comprising a reciprocably mounted shaft assembly wherein a reciprocably mounted shaft extends outwardly away from the actuator bar;

an impurity remover comprising a wiper blade assembly having a wiper blade mounted on the reciprocably mounted shaft, the wiper blade being movable between a wiping position and a non-wiping position;

a first actuator control connected to the impurity remover actuator assembly to selectively move the reciprocally mounted shaft and wiper blade to the wiping position;

a second actuator control connected to the impurity actuator assembly to move the reciprocably mounted shaft and wiper blade back from the wiping position to the non-wiping position;

whereas the wiping blade is readily accessible for cleaning and replacement of the wiping blade; and wherein the reciprocably mounted shaft assembly comprises a stop block and a push block connected to said shaft and a bias member and wiper blade assembly mounted on said shaft.

2. A slideably removable, compact and easily accessible cylinder impurity remover apparatus as described in claim 1, wherein the stop block and push block are mounted on opposite sides of the actuator bar and the bias member is mounted between the stop block and the actuator bar.

3. A slideably removable, compact and easily accessible cylinder impurity remover apparatus as described in claim 1, wherein the adjustable stop block is connected to the reciprocably mounted shaft with an adjusting screw to adjustably pre-select and limit axial movement of the reciprocably mounted shaft and resultant contact of said wiper blade member with the printing plate.

4. A slideably removable, compact and easily accessible cylinder impurity remover apparatus as described in claim 1, wherein the push block connected to the reciprocably mounted shaft is engagable with a floating piston to axially move the reciprocably mounted shaft to the wiping position.

* * * * *